US006685352B1

(12) United States Patent
Capt et al.

(10) Patent No.: US 6,685,352 B1
(45) Date of Patent: Feb. 3, 2004

(54) TIMEPIECE POWER RESERVE INDICATOR DEVICE

(75) Inventors: Edmond Capt, Le Brassus (CH); Alain Zaugg, Le Brassus (CH)

(73) Assignee: Frederic Piguet S.A., Le Brassus (CH)

( * ) Notice: Subject to any disclaimer, the term of this patent is extended or adjusted under 35 U.S.C. 154(b) by 125 days.

(21) Appl. No.: 09/631,381

(22) Filed: Aug. 3, 2000

(30) Foreign Application Priority Data

Aug. 4, 1999 (EP) ..... 99115389

(51) Int. Cl.[7] ..... G04B 3/00; G04B 9/00
(52) U.S. Cl. ..... 368/206; 368/210; 368/66
(58) Field of Search ..... 368/210–216, 368/66, 206

(56) References Cited

U.S. PATENT DOCUMENTS 2,698,066 A * 12/1954 Favret ..... 185/44
2,774,252 A 12/1956 Meyer
3,357,174 A 12/1967 Guyot
3,901,021 A * 8/1975 Tutiya ..... 368/208
4,259,735 A * 3/1981 Vuille ..... 368/185
5,828,628 A * 10/1998 Born et al. ..... 368/140
6,166,999 A * 12/2000 Jujo et al. ..... 368/203

FOREIGN PATENT DOCUMENTS

CH 13340 11/1896
CH 617 815 6/1980
CH 689414 A3 * 4/1999

* cited by examiner

*Primary Examiner*—Randy Gibson
*Assistant Examiner*—Michael L. Lindinger
(74) *Attorney, Agent, or Firm*—Sughrue Mion, PLLC

(57) ABSTRACT

The present invention concerns a power reserve indicator device (1) for a manually or automatically wound timepiece, said timepiece including a barrel, a mainspring housed in the barrel and time display elements mechanically coupled to said barrel, said indictor device (1) including a differential gear (10) a first input (8) of which is driven by a winding gear train (6) which meshes with a first driving gear formed by the barrel core, the output (16) of said differential gear (10) driving a display gear train (18) for indicating the reserve of power assured by the number of winding turns of the mainspring, characterised in that the second input (14) of the differential gear (10) is driven by a letting down gear train (12) which meshes with a second driving gear formed by the outer toothing of said barrel or by a wheel and pinion driven by said barrel.

12 Claims, 3 Drawing Sheets

TIMEPIECE POWER RESERVE INDICATOR DEVICE

BACKGROUND OF THE INVENTION

The present invention concerns a timepiece power reserve indicator device, i.e. a device allowing the degree of development or winding of the mainspring of a mechanical timepiece to be indicated to the wearer.

Timepiece power reserve indicator devices such as that described in Swiss Patent No. CH 689 414 are already known. This indicator includes an operating pinion which is secured to the hour wheel and whose staff constitutes the staff of a plane differential gear. Said operating pinion drives a satellite pinion which pivots on a plate and which meshes with the inner toothing of a differential crown. This differential crown, which is freely fitted onto a cylindrical core of the plate, includes an outer toothing which meshes with a power reserve pinion secured to the barrel arbour.

When the hour wheel rotates, it drives the operating pinion which meshes with the satellite pinion. Since the differential crown is substantially stationary during the normal working of the watch, the satellite pinion rotates on itself about its axis and rolls on the inner toothing of said differential crown, which causes the plate to rotate. The plate itself carries an indicator disc which makes an angular movement as a function of the reserve of power which can still be assured by the winding of the mainspring.

Conversely, when the mainspring is wound, the hour wheel, and thus the operating pinion, remain substantially stationary. However, the barrel arbour on which a pinion is mounted, rotates. By rotating, this barrel arbour pinion drives the differential crown via an intermediate wheel. In turn, the differential crown meshes with the satellite via its inner toothing. Since the hour wheel is stationary, the satellite rolls on the operating pinion and drives the plate in rotation. The indicator disc, carried by the plate, makes an angular movement in the opposite direction to the previous one as a function of the power reserve assured by the number of winding turns of the mainspring.

The power reserve indicator mechanism described above has serious drawbacks. When the hands of the watch are being set, this mechanism has to be blocked to prevent the power reserve indication being made incorrect by the rotation of the hour wheel onto which the operating pinion is secured. In order to overcome this problem, Swiss Patent No. CH 689 414 proposes a rather complex system wherein the power reserve indicator disc is fitted elastically onto the plate. A hand-setting spring moves under the action of the hand-setting stem and acts onto a limitation stud which compresses the indicator disc against the frame, so that said indicator disc is no longer driven by the plate and remains stationary in the position which it occupies. A construction of this type, including several parts in movement with respect to each other, is unreliable and easily able to be damaged.

SUMMARY OF THE INVENTION

The object of the present invention is to overcome the above problems and drawbacks in addition to others by providing a timepiece power reserve indicator device which is compact and of very simple design.

The present invention therefore concerns a power reserve indicator device for a manually or automatically wound timepiece, said timepiece including a barrel, a mainspring housed in the barrel and time display elements mechanically coupled to said barrel, said indicator device including a differential gear a first input of which is driven by a winding gear train which meshes with a first driving gear formed by the barrel core, the output of said differential gear driving a display gear train for indicating the reserve of power assured by the number of winding turns of the mainspring, characterised in that the second input of the differential gear is driven by a letting down gear train which meshes with a second driving gear formed by the outer toothing of said barrel or by a wheel and pinion driven by said barrel.

As a result of these features, the present invention provides a power reserve indicator device including distinct winding and letting down gear trains, so that this device can easily be integrated in a large number of different watch movements.

According to a complementary feature of the invention, the differential gear is positioned at the centre of the movement, on the hour wheel. This allows the power reserve display to be distributed indifferently over all the positions of the dial, and the differential gear to be arranged inside the date disc. Moreover, if the differential gear was not positioned at the centre of the movement, it would have to be smaller, and would thus be more difficult to make.

According to another feature of the invention, the differential gear is of the simple planetary type whereas usually the differential gears used in power reserve indicator mechanisms are of the double satellite and double central pinion planetary type. This solution thus allows a flatter differential gear to be obtained than in the past, which substantially reduces the bulkiness thereof.

BRIEF DESCRIPTION OF THE DRAWINGS

Other features and advantages of the present invention will appear more clearly upon reading the following detailed description of an embodiment example of the power reserve indicator device according to the invention, this example being given purely by way of non limiting illustration, in conjunction with the annexed drawings in which.

DETAILED DESCRIPTION OF THE INVENTION

Figure 1:
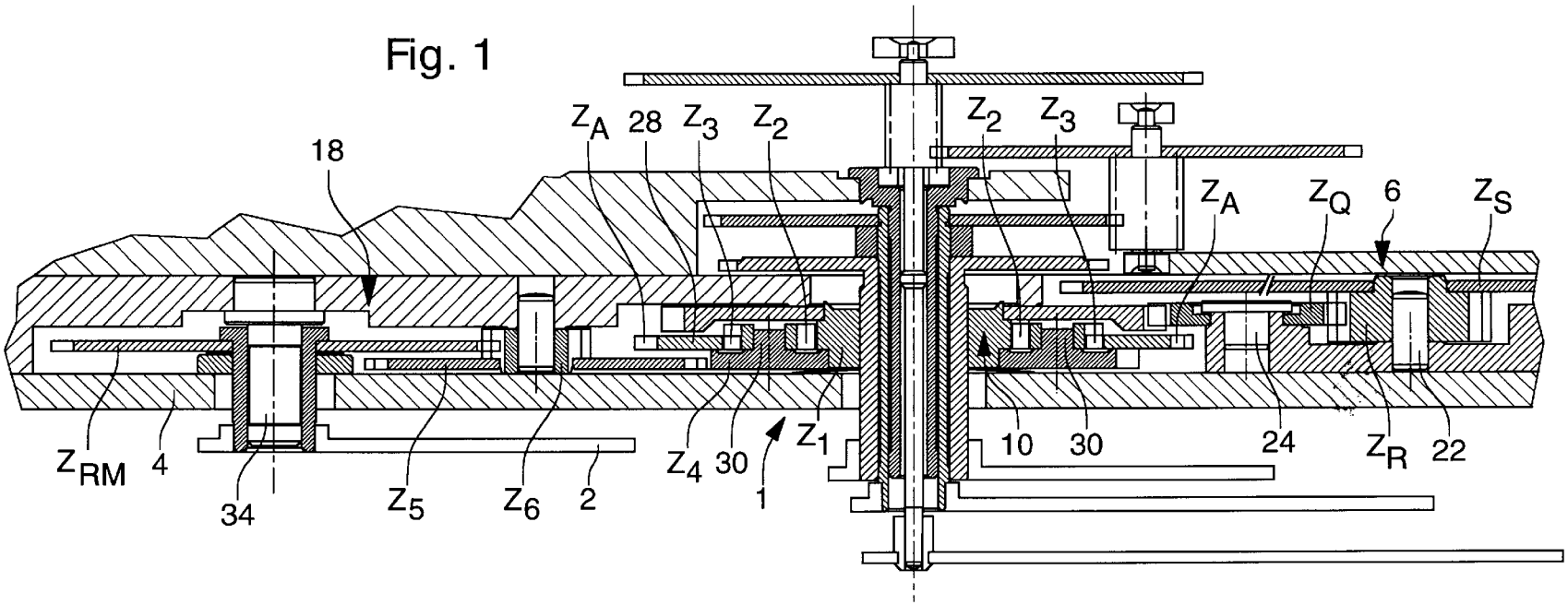
FIG. 1 is an elevation view of the power reserve indicator mechanism according to the invention in which the winding gear train and the display gear train are more particularly shown.
Figure 2:
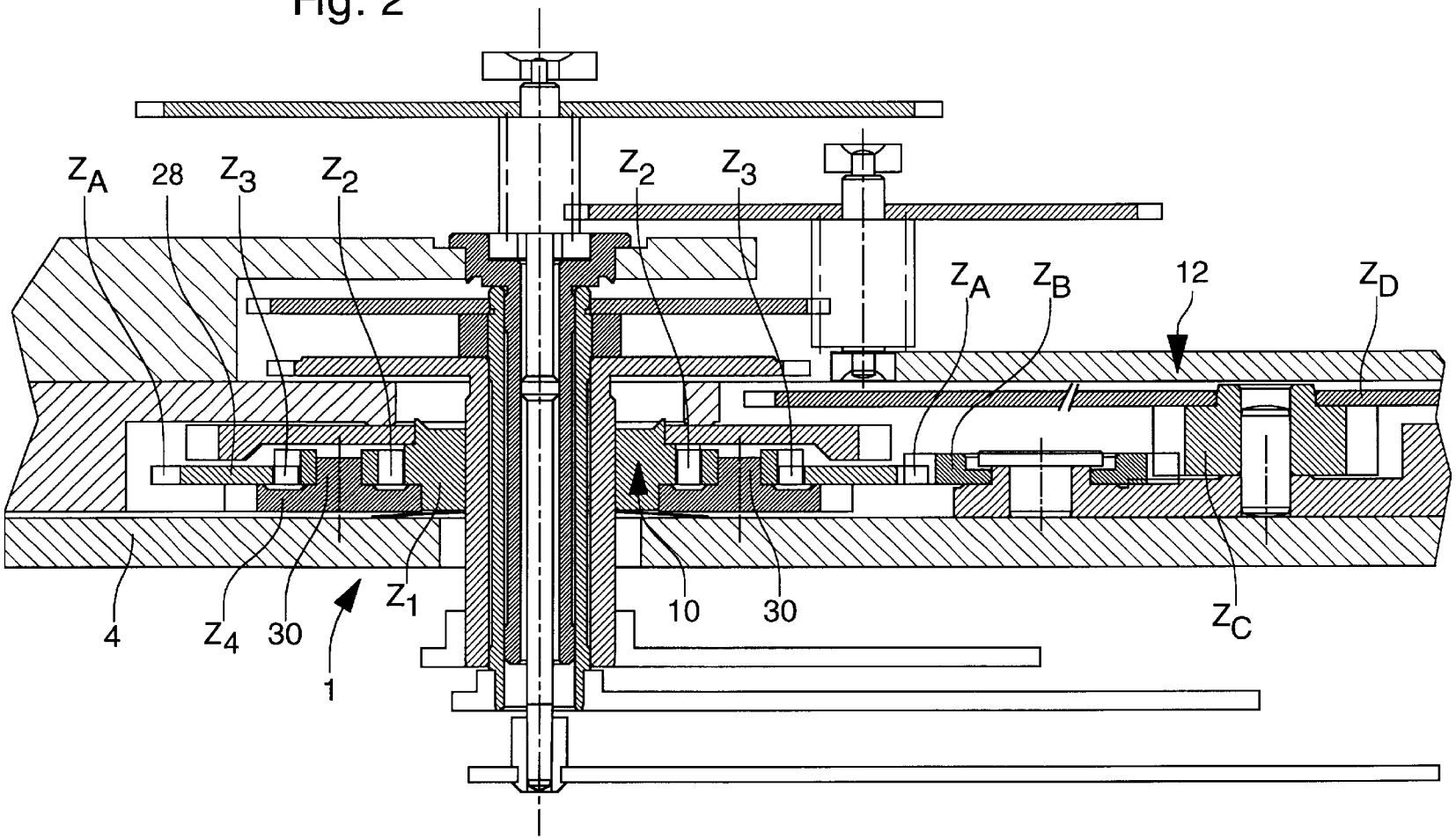
FIG. 2 is a similar view to that of FIG. 1 in which the letting down gear train is shown.

The elevation views of FIGS. 1 and 2 partially illustrate a timepiece of the wristwatch type for example, fitted with a power reserve indicator device according to the present invention and designated as a whole by the general numerical reference 1. The watch includes a clockwork movement provided with a barrel (not shown) in which is housed a mainspring (also not shown). The movement may, according to the particular case, be wound manually or automatically. In the latter case, a disconnecting gear device has to be provided to avoid falsifying the power reserve indication when the mainspring is wound to the maximum and when the spring slips onto the walls of the barrel.

Power reserve indicator device 1 includes a rotating display element formed, for example, of a power reserve hand 2. As a function of the relative position which it occupies with respect to a mark made on dial 4 of the timepiece, this hand 2, indicates to the wearer the available power reserve as a function of the number of winding turns of the mainspring.

Figure 3:
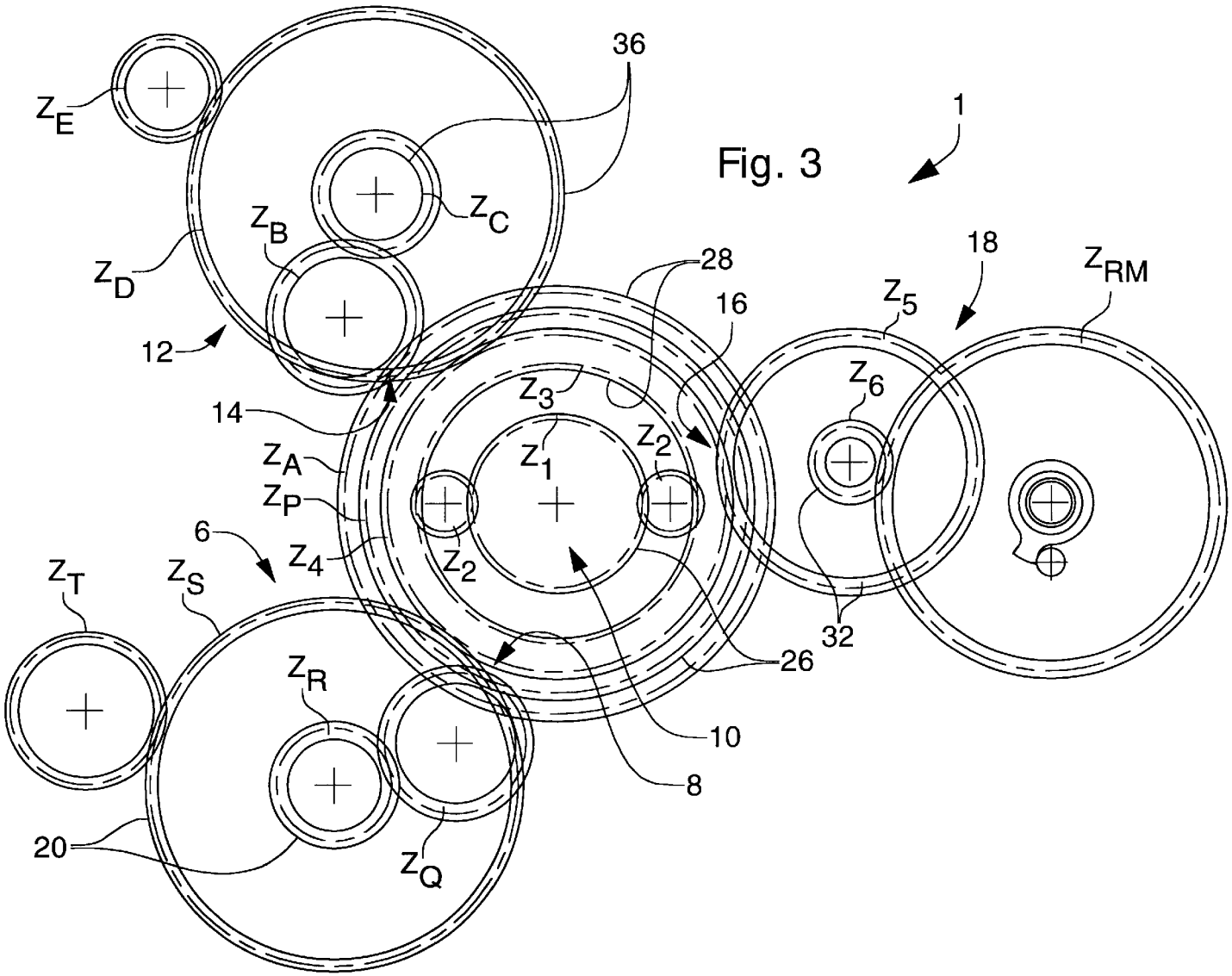
FIG. 3 is a plane view of the drive mechanism for the power reserve indicator according to the invention, the display elements having being omitted.

A close study of FIGS. 1 to 3 will allow the operation of the drive mechanism for display element 2 of the power reserve indicator device according to the invention to be understood.

The driving in rotation of hand 2 is achieved using two kinematic chains driven by a first and a second driving gear, namely respectively the barrel core and the outer toothing of said barrel or a wheel and pinion driven by said barrel.

The first kinematic chain, also called the winding gear train, is designated as a whole by the general numerical reference 6. This first kinematic chain 6 meshes with a first input 8 of a differential gear 10.

The second kinematic chain, also called the letting down gear train, is designated as a whole by the general numerical reference 12. This second kinematic chain 12 meshes with a second input 14 of aforementioned differential gear 10.

Finally, output 16 of differential gear 10 meshes with a third kinematic chain 18 also called the display gear train which drives display hand 2 in rotation.

We will now examine the different elements which form the above enumerated kinematic chains in succession.

As regards winding gear train 6, an intermediate winding wheel $Z_T$ is driven onto the barrel arbour (not shown) of the watch. Intermediate winding wheel $Z_T$ is meshed with an intermediate winding wheel and pinion 20 comprising an intermediate winding pinion $Z_R$ driven onto the rotational staff 22 of an intermediate winding wheel $Z_S$. Intermediate winding wheel and pinion 20, via its pinion $Z_R$, in turn drives an intermediate winding wheel $Z_Q$ driven onto a rotational staff 24. Said intermediate wheel $Z_Q$ then meshes with first input 8 of differential gear 10. This first input 8 is formed by an input wheel and pinion of satellite 26 including a satellite input pinion $Z_1$, driven onto a satellite input wheel Zp.

As will be better understood hereinafter when the operation of power reserve indicator device 1 according to the invention is described in more detail, satellite input pinion $Z_1$drives two satellite pinions $Z_2$ which, in turn, mesh with inner toothing $Z_3$ of a differential crown 28. The two satellite pinions $Z_2$ are freely fitted onto rotational staffs 30 carried by an intermediate satellite output wheel $Z_4$.

As regards display gear train 18, this is formed by an intermediate display wheel and pinion 32 including an intermediate display pinion $Z_6$ driven onto an intermediate display wheel $Z_5$. Intermediate display wheel and pinion 32, arranged at output 16 of differential gear 10, is driven in rotation by intermediate satellite output wheel $Z_4$. In turn, said intermediate display wheel and pinion 32 meshes, via its pinion $Z_6$, with a power reserve display wheel $Z_{RM}$ on staff 34 onto which is driven display element 2.

Finally, letting down gear train 12 includes a letting down intermediate wheel $Z_E$ which meshes with a second driving gear formed by the outer toothing of the barrel or by a wheel and pinion driven by said barrel (not shown). Intermediate letting down wheel $Z_E$ meshes with an intermediate letting down wheel and pinion 36 which includes an intermediate letting down pinion $Z_C$ driven onto the rotational staff of an intermediate letting down wheel $Z_D$. Intermediate letting down wheel and pinion 36 in turn drives, via its pinion $Z_C$, an intermediate letting down wheel $Z_B$. Said intermediate wheel $Z_B$ then meshes with second input 14 of differential gear 10. This second input 14 is formed by outer toothing $Z_A$ of differential crown 28.

When the watch operates normally, i.e. when the mainspring is in the process of letting down, intermediate letting down wheel $Z_E$ is driven in rotation by the outer toothing of the barrel or by a wheel and pinion which meshes with said outer toothing. In turn, intermediate letting down wheel $Z_E$ meshes with wheel $Z_D$ of intermediate letting down wheel and pinion 36 whose pinion $Z_C$ is meshed with intermediate letting down wheel $Z_B$. Said intermediate wheel $Z_B$ then meshes with outer toothing $Z_A$ Of differential crown 28. Finally, differential crown 28 drives, via its inner toothing $Z_3$, the two satellite pinions $Z_2$.

During the normal operation of the watch, winding gear train 6 does not rotate. Consequently, satellite input wheel $Z_P$ and satellite input pinion $Z_1$ driven onto said wheel $Z_P$ are stationary. The two satellite pinions $Z_2$, driven in rotation by inner toothing $Z_3$ of differential crown 28, thus rotate on themselves about their respective staffs 30 and roll on satellite input pinion $Z_1$ which is fixed. Since intermediate satellite output wheel $Z_4$ carries the two satellite pinions $Z_2$, it is driven in rotation by said satellite pinions $Z_2$. By rotating, intermediate satellite output wheel $Z_4$ meshes with intermediate display wheel and pinion 32 whose pinion $Z_6$ drives power reserve display wheel $Z_{RM}$ and display hand 2 which is secured to said display wheel $Z_{RM}$. Display hand 2 thus makes an angular movement as a function of the power reserve which can still be assured by the winding of the mainspring.

When the watch is wound with a view to winding the mainspring, the barrel arbour drives intermediate winding wheel $Z_T$ in rotation. In turn, intermediate winding wheel $Z_T$ meshes with wheel $Z_S$ of intermediate winding wheel and pinion 20 whose pinion $Z_R$ is meshed with intermediate winding wheel $Z_Q$. Said intermediate wheel $Z_Q$ then meshes with satellite input wheel $Z_P$. Finally, satellite input pinion $Z_1$, which rotates at the same time as said satellite input wheel $Z_P$,drives satellite pinions $Z_2$ in rotation.

During the winding of the watch, letting down gear train 12 is substantially stationary. Consequently, differential crown 28 with its outer toothing $Z_A$ and inner toothing $Z_3$ does not rotate. The two satellite pinions $Z_2$, driven in rotation by satellite input pinion $Z_1$, thus rotate on themselves about their respective staffs 30 and roll on inner toothing $Z_3$ of differential crown 28 which is stationary. Since intermediate satellite output wheel $Z_4$ carries the two satellite pinions $Z_2$, it is driven in rotation by said satellite pinions $Z_2$ in the opposite direction to the preceding one. By rotating, intermediate satellite output wheel $Z_4$ meshes with intermediate display wheel and pinion 32 whose pinion $Z_6$ drives power reserve display wheel $Z_{RM}$ and display hand 2 which is linked to said display wheel $Z_{RM}$. Display hand 2 thus makes an angular movement in the opposite direction to the preceding one as a function of the power reserve assured by the number of winding turns of the mainspring.

It will be noted the compactness of the proposed construction, which is particularly remarkable due to the use of a differential gear 10 of the simple planetary type including only one satellite input pinion $Z_1$, two satellite pinions $Z_2$ and a differential crown 28 with an inner toothing $Z_3$ and an outer toothing $Z_A$. This allows the thickness of the timepiece fitted with a device according to the invention to be substantially reduced. Thus, this construction can be mounted without any difficulty in a wristwatch.

It will also be noted that differential gear 10 is positioned at the centre of the movement, on hour wheel 38. This advantageously allows the power reserve indication display to be distributed indifferently over all the positions of the dial, and thus to be adapted to the aesthetic appearance of the watch dial. Moreover, since differential gear 10 is arranged at the centre of the movement, it is possible to make it with more significant geometrical dimensions than if it were housed at the periphery of the case, hence greater manufacturing simplicity.

Finally, the fact that winding gear train 6 and letting down gear train 12 form two perfectly distinct gear trains offers those skilled in the art the possibility of adapting the mechanism according to the present invention to a large number of different watch movements.

It goes without saying that the invention is not limited to the embodiment which has just been described, and that modifications and variants may be envisaged without departing from the scope of the invention.

What is claimed is:

1. A power reserve indicator device for a wound timepiece, said timepiece including a barrel, a mainspring housed in the barrel and time display elements mechanically coupled to said barrel, said indicator device including a differential gear a first input of which is driven by a winding gear train which meshes with a first driving gear formed by the barrel core, the output of said differential gear driving a display gear train for indicating the reserve of power assured by the number of winding turns of the mainspring, wherein the second input of the differential gear is driven by a letting down gear train which meshes with a second driving gear formed by outer toothing of said barrel, wherein said differential gear includes a differential crown having an inner toothing and an outer toothing.

2. A device according to claim 1, wherein the differential gear is positioned at the centre of the movement, on the hour wheel.

3. A device according to claim 1, wherein the differential gear is of the simple planetary type.

4. A device according to claim 1, wherein the differential gear further includes a satellite input wheel and pinion including a satellite input pinion driven onto a satellite input wheel, as well as two satellite pinions.

5. A device according to claim 4, wherein the two satellite pinions are carried by an intermediate satellite output wheel.

6. A device according to claim 1, wherein the winding gear train includes an intermediate winding wheel driven onto the barrel arbour, this intermediate winding wheel being meshed with an intermediate winding wheel and pinion including an intermediate winding pinion driven onto the rotational staff of an intermediate winding wheel, said intermediate winding wheel and pinion in turn driving, via its pinion, an intermediate winding wheel.

7. A device according to claim 1, wherein the letting down gear train includes an intermediate letting down wheel which meshes with the outer toothing of the barrel, said intermediate letting down wheel meshing with an intermediate letting down wheel and pinion which includes an intermediate letting down pinion driven onto the rotational staff of an intermediate letting down wheel, said intermediate letting down wheel and pinion in turn driving, via its pinion, an intermediate letting down wheel.

8. A device according to claim 1, wherein the display gear train includes an intermediate display wheel and pinion including an intermediate display pinion driven onto an intermediate display wheel.

9. A device according to claim 1, wherein the display gear train drives a power reserve display wheel onto the rotational staff of which is driven a power reserve indicator element.

10. A device according to claim 9, wherein the power reserve indicator element is a hand.

11. A power reserve indicator device for a wound timepiece, said timepiece including a barrel, a mainspring housed in the barrel and time display elements mechanically coupled to said barrel, said indicator device including a differential gear a first input of which is driven by a winding gear train which meshes with a first driving gear formed by the barrel core, the output of said differential gear driving a display gear train for indicating the reserve of power assured by the number of winding turns of the mainspring, wherein the second input of the differential gear is driven by a letting down gear train which meshes with a second driving gear formed by a wheel and pinion driven by said barrel, wherein said differential gear includes a differential crown having an inner toothing and an outer toothing.

12. The device according to claim 11, wherein the letting down gear train includes an intermediate letting down wheel which meshes with the wheel and pinion driven by said barrel, said intermediate letting down wheel meshing with an intermediate letting down wheel and pinion which includes an intermediate letting down pinion driven onto the rotational staff of an intermediate letting down wheel, said intermediate letting down wheel and pinion in turn driving, via its pinion, an intermediate letting down wheel.

* * * * *